US006665969B1

(12) United States Patent
Conway

(10) Patent No.: US 6,665,969 B1
(45) Date of Patent: Dec. 23, 2003

(54) MOUNT FOR TANDEM SIGN

(75) Inventor: Thomas M Conway, Chicago, IL (US)

(73) Assignees: Cormark, Inc.; Des Plaines, Inc.

( * ) Notice: Subject to any disclaimer, the term of this patent is extended or adjusted under 35 U.S.C. 154(b) by 0 days.

(21) Appl. No.: 10/246,443

(22) Filed: Sep. 18, 2002

(51) Int. Cl.[7] ..... G09F 7/00
(52) U.S. Cl. ..... 40/605; 40/606.15; 40/611.06
(58) Field of Search ..... 40/584, 605, 606.01, 40/606.15, 611.01, 611.02, 611.03, 611.06, 611.07, 611.11

(56) References Cited

U.S. PATENT DOCUMENTS 3,174,365 A 3/1965 Lucarelli
4,505,061 A * 3/1985 Neuburger et al. ..... 40/605
5,803,420 A 9/1998 Conway et al.
5,860,537 A * 1/1999 Loew ..... 40/649
5,924,367 A * 7/1999 Henke et al. ..... 40/661.03
5,934,633 A 8/1999 Padiak et al.
6,003,697 A * 12/1999 Ferchat et al. ..... 40/601
6,318,684 B1 * 11/2001 Ireland et al. ..... 40/606.15
6,378,818 B1 * 4/2002 Padiak et al. ..... 40/606.15
6,484,988 B2 11/2002 Conway et al.

* cited by examiner

*Primary Examiner*—Gary Hoge
(74) *Attorney, Agent, or Firm*—Welsh & Katz, Ltd.

(57) ABSTRACT

A sign mounting system for mounting at least two signs portions to an associated structure mounts the sign portions in an aligned manner so that separate sign portions appear as a single sign. The mounting system includes a plurality of sign mounts, one sign mount for each of the sign portions. Each of the sign mounts is configured to support a sign portion. Each sign mount includes first and second brackets and an arm associated with each bracket. The arms pivot about the brackets at a pivot axis. The first and second brackets have oppositely, outwardly facing surfaces. The outwardly facing surface of the first bracket has a first mating element thereon and the outwardly facing surface of the second bracket has a second mating element thereon. The second mating element of the second bracket of the first sign mount is configured to mate with the first mating element of the first bracket of the second sign mount to maintain the two sign portions aligned with one another.

17 Claims, 1 Drawing Sheet

V1
V2
S1
S2
S
2
4
56
16a
70
66
14b
68
72
44a
46a
54
48
46b
44b
76
78
18
22
80
74
58
12
52
62
60
50
34
18a
E1
A
24
12a
16b
64
26
42
20
32
28
38
E2
36
18b
12b
10
22b (24b)
30
40
22a
(24a)

MOUNT FOR TANDEM SIGN

BACKGROUND OF THE INVENTION

The present invention pertains to a sign mounting system for side-by-side or tandem mounting of pivotal signs. More particularly, the present invention pertains to a pivotal sign mount system that permits two or more signs to be mounted side-by-side to one another to provide an expanded display.

Signs, and more particularly, point of purchase sign or display systems can, when properly designed, be tremendously effective marketing tools. These systems have become widely popular in all manners of retail trade.

In one common use, signs are mounted to shelving systems that permit loading of pallets and palletized items onto the stocking shelves. These are commonly referred to as pallet racks. These arrangements permit the storage of large items and large amounts of items on each of the shelves. However, these shelves do not typically lend themselves to the mounting of point-of-purchase displays or signs thereon.

Many known signs are permanently or semi-permanently affixed to the shelves and are hung above or below the shelving systems. While many of these signs work quite well to direct the consumer's attention to the particular products, they do not permit ready access to the shelves to, for example, restock the shelves or retrieve items from the shelves. This, of course, is particularly true of those signs that are permanently or semi-permanently affixed to the shelves.

Known mounting systems include those disclosed in Padiak et al., U.S. Pat. No. 5,934,633, entitled "Pivotal, Two-Position Locking Sign Mounting System" and Conway et al., U.S. Pat. No. 5,803,420, entitled "Universal Sign Mounting Device", both of which are commonly assigned with the present application, and in copending U.S. patent application Ser. No. 10/044,601, to Conway et al., which application is commonly assigned herewith. These systems function well for their intended purposes. The systems disclosed in the '633 and '420 patents require some locking arrangement to maintain the sign in a storage (e.g., open) or display (e.g., closed) position. The application to Conway et al., uses a biasing element, such as a spring to maintain the sign in the down or up (e.g., display or storage) position. The aforementioned patents and application are incorporated herein by reference.

One drawback to these known sign systems is that they are limited to use in single sign displays. That is, there is no manner is which two or more signs can be mounted side-by-side, to appear as one large sign but to function independently. Such an arrangement may be desirable where, for example, a large display is desired or the display is to be viewed from an extreme distance, without the inconvenience of a single large, cumbersome assembly.

Accordingly there exists a need for a point-of-purchase display or sign mounting system that is used to position a sign in a particular, desired orientation and position, and that is effective for point-of-purchase marketing. Desirably such a system permits two or more signs to be mounted in a side-by-side manner to permit the signs to appear as one large display, but to function as independent units.

BRIEF SUMMARY OF THE INVENTION

A sign mounting system is used to mount at least two signs portions to an associated structure. The sign portions are mounted in an aligned manner so that separate sign portions appear as a single sign. The mounting system includes a plurality of sign mounts. That is, one sign mount is present for each of the sign portions. The sign mounts are each configured to support a single sign portion.

Each sign mount includes first and second brackets and an arm associated with each bracket. The arms pivoting about the brackets at a pivot axis. In a preferred embodiment, the arms are biasedly mounted to the brackets and include a biasing element operable connecting each arm to its respective bracket. The biasing element biases the arm to a storage position or a display position when the arm is in any position intermediate the storage position and the display position.

The first and second brackets have oppositely, outwardly facing surfaces. The outwardly facing surface of the first bracket has a first mating element and the outwardly facing surface of the second bracket has a second mating element. The second mating element of the second bracket of the first sign mount is configured to mate with the first mating element of the first bracket of the second sign mount to maintain the two sign portions aligned with one another.

In a current embodiment, each bracket includes first and second spaced apart outwardly extending flanges. The flanges each define an outwardly oriented surface. The first mating element is disposed on the outwardly oriented surface of the first flange and the second mating element is disposed on the outwardly oriented surface of the second flange. In a current embodiment, the first mating element is an outwardly extending projection and the second mating element is an outwardly extending ring. The projection is configured for positioning within the ring and for engaging an inner surface of the ring.

The arms of brackets that are adjacent one another define inside arms. The arms of brackets that are not adjacent another bracket define outside arms. To secure the outsides of the sign portions, the outside arms have caps positioned on an outer edge thereof. The caps are preferably reversible so that they can be used on either side of the sign.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figures 1, 2, 3, 4:
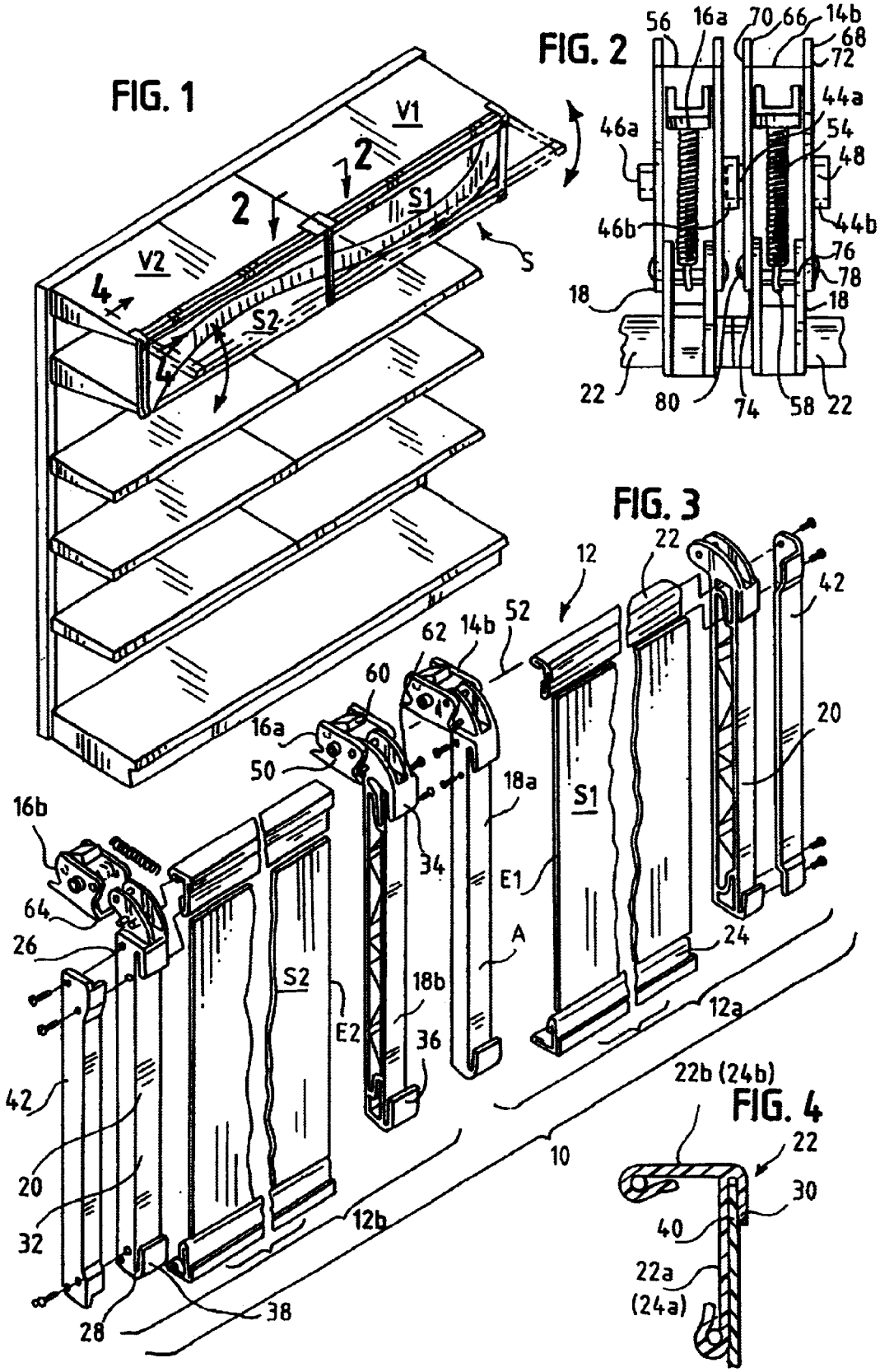
FIG. 1 is a perspective view of a sign mount system having a pair of tandem sign mounts embodying the principles of the present invention, the mounts securing two signs to one another and being mounted to a display shelf, the signs being illustrated in the display position in solid lines and in the storage position in phantom lines.
FIG. 2 is a cross-section of the pair of tandem sign mounts taken along line 2—2 of FIG. 1.
FIG. 3 is an exploded view of a the sign mount system of FIG. 1.
FIG. 4 is a cross-sectional view taken along line 4—4 of FIG. 1.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated. It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1 there is shown a sign mounting system 10 for side-by-side or tandem mounting of signs S ($S_1$, $S_2$). For purpose of the present disclosure, the term sign refers to, generally, the sign, graphic or media that is used for the display portion of the system. The mounting system 10 includes, as shown, two separate sign mounts 12 (12*a*, 12*b*) that are mounted to adjacent shelves $V_1$, $V_2$ of a shelving system.

Each sign mount 12 includes a pair of brackets 14, 16 that are mounted to the shelf, for example, shelf $V_1$. An arm 18, 20 is mounted to each bracket, 14, 16, generally parallel to one another. Rails 22, 24 extend between the arms 18, 20 at the bracket ends 26 and at the free ends 28. The arms 18, 20 and rails 22, 24 define a frame for the sign or graphic portion S of the system. In a current embodiment, the rails 22, 24 are formed by extrusion methods, which methods will be recognized by those skilled in the art.

The rails 22, 24 are formed having generally transverse support legs 22*a,b* and 24*a,b*. A capture flange 30 extends along each rail 22, 24 parallel and spaced from one of the legs 22*a*, 24*a*, and transverse to the other leg 22*b*, 24*b*. The graphic S is held between the capture flange 30 and one of the support legs 22*a*, 24*a*.

The brackets 14, 16 are configured to permit the facing or inside arms 18 to abut one another in an aligned manner. In this way, for example, a two-piece graphic $S_1$, $S_2$ can be mounted (with a first section of graphic $S_1$ on one of the sign mounts 12*a* and a second section of graphic $S_2$ on the other sign mount 12*b*) so that the graphic $S_1$, $S_2$ appears to be continuous without a seam or support between the graphic sections $S_1$, $S_2$.

As best seen in FIG. 3, the arms 18, 20 include a longitudinal support member 32 and upper and lower capture flanges 34, 36. The arms 18, 20 and rails 22, 24 are mounted to one another so that the arm capture flanges 34, 36, 38 and the rail capture flanges 30 align with one another. In this manner, the graphic $S_1$, $S_2$ can be slid into the aligned spaces 40 between the support member 32 and the arm flange 34, 36, 38 and between the legs 22*a*, 24*a* and the rail flange 30. This arrangement permits readily changing the graphic S as desired. To facilitate this sideby-side arrangement, the inner arms 18 are cap-less. The outer arms 20 include caps 42 that are fitted over an outside edge of the arm 20 to prevent the graphic S from sliding out of the captured space 40. In a present embodiment, the arms 20 and caps 42 are configured such that the caps 42 can be fitted onto an arm 20*a*, 20*b* on the left or right side of the system 10 and are reversible, top to bottom.

To maintain the brackets 14, 16 aligned with one another, the brackets 14, 16 include aligning means. In a current, embodiment, the aligning means includes mating elements 44*a,b* and 46*a,b* on each side of the bracket. As configured, a first mating element 44*a* on a first side of the bracket 14*b* mates with a second mating element 46*b* on an opposing side of an adjacent bracket 16*a* to assure that the adjacent brackets 14*b*, 16*a* are aligned with one another. In a present embodiment, the mating elements 44*a,b* and 46*a,b* include a circular peg or projection 44*a*, 46*a* and a ring 44*b*, 46*b* into which the peg 44*a*, 46*a* fits. Each of the brackets 14, 16 includes the peg 44 extending outwardly from one wall (the same wall for each bracket 14, 16) and the ring 46 extending outwardly from the other wall (again the same wall for each bracket 14, 16). Each ring 46 is formed having an inner surface 48 against which the peg 44 bears when the peg 44 and ring 46 are mated with one another. In this manner, every bracket 14, 16 can be mated with any other bracket 14, 16.

As is best seen in FIG. 2, the mated brackets 14*b*, 16*a* permit the inside or abutting side edges $E_1$, $E_2$ of the sign portions $S_1$, $S_2$ to be placed sufficiently close to one another to appear as one sign S, and the brackets 14*b*, 16*a* assure that the sign mount arms 18*a,b* are aligned with one another so that the abutting side edges $E_1$, $E_2$ are properly aligned with one another.

As will be appreciated by those skilled in the art, the sign mounts 12*a,b* can be positioned adjacent one another to permit the "joining" of more than two sign portions so that rather long signs can be configured. In such an arrangement, all of the inside or facing arms 18 are all cap-less and the caps 42 are present only on the two outside arm 20 outer edges. To prevent the sign portions $S_1$, $S_2$ and so on, from sliding, an adhesive A (such as a temporary adhesive strip) can be used to secure the sign portions $S_1$, $S_2$ and so on, to the arms 18. Even the outside arms 20 (those arms with caps 42) can include the adhesive A to maintain the sign portions $S_1$, $S_2$ and so on fixed to their respective outer arms 20, to prevent sliding.

In a present embodiment, the sign mounts 12*a,b* are pivotal and include a bias assist to facilitate maintaining the signs in the display or the storage position. In such a sign mount 12*a,b*, the bracket 14,16 is configured for attaching to the structure, e.g., the shelving system shelf V, and the arm 18, 20 is mounted to the bracket 14 and defines a pivot portion 50 having a pivot axis 52 about the bracket 14, 16. A biasing element, such as the exemplary coil spring 54, is connected to the bracket 14, 16 and to the arm 18, 20 at respective spring mounts 56, 58. The mounting system 10 uses the tendency of the spring 54 to return to a least or less stressed state to maintain the sign S in the display or storage position, as desired.

The mount system 10 can configured as a tension-biased system in which the spring 54 is connected to the bracket 14, 16 and the arm 18, 20 so that the arm 18, 20 is maintained in either the display or storage position, as desired, by the spring 54 under tension. When the arm 18, 20 is moved between the display and storage positions, the spring 54 moves through an actuate path, crossing the pivot axis 52 (which defines a maximum state of tension). As presently configured, the display and storage positions are 180° from one another by rotation of the arms 18, 20.

The brackets 14, 16 can include an upper stop surface 60 to engage a lip 62 formed on the arm 18, 20 to prevent over-rotation of the arm 18, 20 beyond the storage position. The bracket 14, 16 can also includes a lower stop surface 64 for engaging the arm 18, 20 to prevent over-rotation of the arm 18, 20 beyond the display position.

As illustrated, each bracket 14, 16 (as shown by bracket 14) includes first and second spaced apart outwardly extending flanges 66, 68. The mating aligning elements 44*a,b* and 46*a,b* are formed on outer surfaces 70, 72 of the flanges 66, 68. Each arm 18, 20 (as shown by arm 18) also includes a pair of spaced apart flanges 74, 76, one each associated with a respective bracket flange 66, 68. In this configuration, the spring 54 is disposed between the respective pairs of flanges 66, 74 and 68, 76. Pivot pins 78, 80 extend between flange pairs 66, 74 and 68, 76 for pivoting the arms 18, 20.

Another contemplated embodiment is a spring compression system (not shown). In such a system the bracket includes a spring capturing portion and the arm includes a camming surface spaced from the pivot axis. The spring element is disposed between the bracket and the arm at their respective spring capturing portions. When the arm is moved between the display and storage positions, the spring is compressed into a compressed state by the camming portion of the arm which portion, when compressed against the biasing element, defines a maximum compressed state. In the display and storage positions, the spring is in a state of compression less than the maximum compressed state.

The spring mount systems are disclosed in the aforementioned U.S. patent application Ser. No. 10/044,601 to Conway et al. Those skilled in the art will recognize that a wide variety of other sign mounts can be configured to include the novel tandem sign mount arrangement disclosed herein, all of which other sign mounts are within the scope and spirit of the present invention. Those skilled in the art will also appreciate that although the present invention is disclosed and describe with reference to a horizontally mounted sign (i.e., a horizontal pivot axis), the present tandem sign mount can also be configured for use with a vertically mounted sign (i.e., a vertical pivot axis).

In the present disclosure, the words "a" or "an" are to be taken to include both the singular and the plural. Conversely, any reference to plural items shall, where appropriate, include the singular.

The disclosure of each patent cited herein, whether or not done so specifically, is incorporated herein by reference.

From the foregoing it will be observed that numerous modifications and variations can be effectuated without departing from the true spirit and scope of the novel concepts of the present invention. It is to be understood that no limitation with respect to the specific embodiments illustrated is intended or should be inferred.

What is claimed is:

1. A sign mounting system for mounting at least two signs portions to an associated structure, the sign portions being mounted in an aligned manner so that separate sign portions appear as a single sign, the mounting system comprising:

a plurality of sign mounts, one sign mount for each of the sign portions, the sign mounts including at least first and second sign mounts, each of the sign mounts configured to support a sign portion, each sign mount including first and second brackets and an arm associated with each bracket, the arms pivoting about the brackets at a pivot axis, the first and second brackets having oppositely, outwardly facing surfaces, the outwardly facing surface of the first bracket having a first mating element thereon and the outwardly facing surface of the second bracket having a second mating element thereon, the second mating element of the second bracket of the first sign mount configured to mate with the first mating element of the first bracket of the second sign mount to maintain the two sign portions aligned with one another.

2. The sign mounting system in accordance with claim 1 wherein each bracket includes first and second spaced apart outwardly extending flanges each defining an outwardly oriented surface, and wherein the first mating element is disposed on the outwardly oriented surface of the first flange and the second mating element is disposed on the outwardly oriented surface of the second flange.

3. The sign mounting system in accordance with claim 1 wherein the first mating element is an outwardly extending projection and the second mating element is an outwardly extending ring, the projection configured for positioning within the ring and for engaging an inner surface of the ring.

4. The sign mounting system in accordance with claim 1 wherein the arms of brackets that are adjacent one another define inside arms and wherein the arms of brackets that are not adjacent another bracket define outside arms, the outside arms having caps positioned on an outer edge thereof.

5. The sign mounting system in accordance with claim 4 wherein the caps are reversible.

6. The sign mounting system in accordance with claim 1 wherein the arms are mounted to the brackets and include a biasing element operable connecting each arm to its respective bracket.

7. The sign mounting system in accordance with claim 6 wherein the biasing element biases the arm to a storage position or a display position when the arm is in any position intermediate the storage position and the display position.

8. A sign mounting system for mounting separate first and second signs portions to an associated structure, the sign portions being mounted in an aligned manner so that the two separate sign portions appear as a single sign, the mounting system comprising:

first and second sign mounts, the first sign mount configured to support the first sign portion and the second sign mount configured to support the second sign portion, each sign mount including first and second brackets and an arm associated with each bracket, the arms pivoting about the brackets at a pivot axis, the first and second brackets having oppositely, outwardly facing surfaces, the outwardly facing surface of the first bracket having a first mating element thereon and the outwardly facing surface of the second bracket having a second mating element thereon, the second mating element of the second bracket of the first sign mount configured to mate with the first mating element of the first bracket of the second sign mount to maintain the two separate sign portions aligned with one another.

9. The sign mounting system in accordance with claim 8 wherein each bracket includes first and second spaced apart outwardly extending flanges each defining an outwardly oriented surface, and wherein the first mating element is disposed on the outwardly oriented surface of the first flange and the second mating element is disposed on the outwardly oriented surface of the second flange.

10. The sign mounting system in accordance with claim 8 wherein the first mating element is an outwardly extending projection and the second mating element is an outwardly extending ring, the projection configured for positioning within the ring and for engaging an inner surface of the ring.

11. The sign mounting system in accordance with claim 8 wherein the arms of brackets that are adjacent one another define inside arms and wherein the arms of brackets that are not adjacent another bracket define outside arms, the outside arms having caps positioned on an outer edge thereof.

12. The sign mounting system in accordance with claim 11 wherein the caps are reversible.

13. The sign mounting system in accordance with claim 8 wherein the arms are mounted to the brackets and include a biasing element operable connecting each arm to its respective bracket.

14. The sign mounting system in accordance with claim 13 wherein the biasing element biases the arm to a storage position or a display position when the arm is in any position intermediate the storage position and the display position.

15. A sign mounting system for mounting separate first and second signs portions to an associated structure, the sign portions being mounted in an aligned manner so that the two separate sign portions appear as a single sign, the mounting system comprising:

first and second biased sign mounts, the first sign mount configured to support the first sign portion and the second sign mount configured to support the second sign portion, each sign mount including first and second brackets and an arm associated with each bracket, the arms being biasedly mounted to their respective brackets and pivoting about the brackets at a pivot axis, the arms being biased to a storage position or a display position when the arm is in any position intermediate the storage position and the display position, the first and second brackets having oppositely, outwardly facing surfaces; and means for aligning the outwardly facing surface of the first bracket of the second sign mount with the outwardly facing surface of the second bracket of the first sign mount to maintain the two separate sign portions aligned with one another.

16. The sign mounting system in accordance with claim 15 wherein each bracket includes first and second spaced apart outwardly extending flanges each defining an outwardly oriented surface, and wherein the means for aligning includes a first mating element disposed on the outwardly oriented surface of the first flange and a second mating element disposed on the outwardly oriented surface of the second flange.

17. The sign mounting system in accordance with claim 16 wherein the first mating element is an outwardly extending projection and the second mating element is an outwardly extending ring, the projection configured for positioning within the ring and for Engaging an inner surface of the ring.

* * * * *